United States Patent [19]

Dewitz

[11] Patent Number: 4,797,262

[45] Date of Patent: Jan. 10, 1989

[54] DOWNFLOW FLUIDIZED CATALYTIC CRACKING SYSTEM

[75] Inventor: Thomas S. Dewitz, Houston, Tex.

[73] Assignee: Shell Oil Company, Houston, Tex.

[21] Appl. No.: 56,929

[22] Filed: Jun. 3, 1987

Related U.S. Application Data

[62] Division of Ser. No. 874,758, Jun. 16, 1986, Pat. No. 4,693,808.

[51] Int. Cl.[4] ..... B01J 8/18

[52] U.S. Cl. ..... 422/142; 422/144; 422/145; 422/147

[58] Field of Search ..... 422/142, 144, 145, 147; 208/113, 153, 161, 166, 168, 173; 55/391, 392, 426, 452, 459 R

[56] References Cited

U.S. PATENT DOCUMENTS

| | | | |
|---|---|---|---|
| 2,929,774 | 3/1960 | Smith | 208/113 |
| 3,436,900 | 4/1969 | Evens et al. | 55/452 |
| 3,573,224 | 3/1971 | Strelzoff et al. | 422/142 |
| 3,633,344 | 1/1972 | Blank et al. | 55/452 |
| 4,312,650 | 1/1982 | Seki et al. | 55/452 |
| 4,385,985 | 5/1983 | Gross et al. | 208/113 |
| 4,419,221 | 12/1983 | Castagnos et al. | 422/144 |
| 4,427,538 | 1/1984 | Bartholic | 422/144 |
| 4,664,889 | 5/1987 | Steenge et al. | 422/144 |
| 4,666,675 | 5/1987 | Parker et al. | 422/144 |
| 4,692,311 | 9/1987 | Parker et al. | 422/144 |

*Primary Examiner*—Benoit Castel

*Attorney, Agent, or Firm*—Kimbley L. Muller

[57] ABSTRACT

This invention discloses an integral hydrocarbon conversion apparatus having a downflow hydrocarbon reactor, an upflow riser regenerator and a horizontal cyclone separator to permit the conversion of hydrocarbonaceous materials to hydrocarbonaceous products of lower molecular weight in a near zero pressure drop environment. A leg seal is provided surmounted to the downflow reactor to insure that the pressure is at least 0.5 psi higher than the upper portion of the downflow reactor (higher than the loop seal valve) vis-a-vis the pressure in the lower portion of the downflow reactor.

19 Claims, 2 Drawing Sheets

DOWNFLOW FLUIDIZED CATALYTIC CRACKING SYSTEM

This is a division of application Ser. No. 874,758 filed June 16, 1986 and issued as U.S. Pat. No. 4,693,808 on Sept. 15, 1987.

FIELD OF THE INVENTION

The field of art to which this invention pertains is hydrocarbon processing and an apparatus for carrying out such a process. More particularly, this invention relates to a system in which a fluidized catalyst is continuously regenerated in the presence of an oxygen containing gas in an upflow riser regenerator and passed to a downflow hydrocarbon cracking reactor wherein a hydrocarbonaceous feed material is cracked to a hydrocarbonaceous product material in the presence of a catalytic composition of matter.

Before the advent of viable catalysts, most hydrocarbon material was cracked pyrolytically. This flow sequence usually entailed use of some type of heat exchange material such as heated sand which could flow into the pyrolytic cracking reactor and thereafter be regenerated for reuse. The development of cracking catalysts however led to the formulation of a plethora of catalytic cracking schemes. Realization that the cracking of a hydrocarbonaceous material transpires as much as a 1000 times faster in the presence of various absorptive clays or silica-alumina catalysts quickly antiquated straight thermal cracking.

At least as early as 1942 a fluid bed cracking system was developed utilizing a fluidized catalyst powder. These catalysts are subject to rapid deactivation as a result of the presence of cracking-derived coke containing from about 5 to about 10 wt % hydrogen. The spent catalysts are regenerated to a reactive or cracking activity level near that of a virgin catalyst by burning the cracking-derived coke in the presence of an oxygen-containing gas at elevated temperatures to remove the deactivating coke from the surface of the catalyst. Another problem continually confronted in the catalytic conversion process is that of pressure drop through the reactor system which is especially pronounced in old reactor systems which do not employ a riser reactor tube for the rapid conversion of hydrocarbon feed material to hydrocarbon product material.

Most of the recent advances in the catalytic hydrocarbon cracking art field have concerned the regeneration technique for regenerating the catalyst to a cracking activity level tantamount to that of a virgin catalyst. While many types of elaborate configurations for the regenerator have been developed, most artisans have sought to deliberately raise regeneration temperatures in order to achieve better control of the temperature balance between the reactor and the regenerator.

BACKGROUND OF THE INVENTION

An apparatus for the continuous cracking of hydrocarbons in a thermal manner is disclosed in Schmalfeld et al, U.S. Pat. No. 3,215,505, wherein an upflow regenerator acts to recondition heat transfer particles, such as sand in an elongated pneumatic elevator for passage, after separation, with vapors into a thermal cracking reactor. The inlet channel for the heat carrier material discharges into the top of a pyrolytic reactor having an internal baffle structure to overcome problems of gas bubbles propelling the heat transfer material in an upward direction. In a preferred embodiment of the patentees applicable hydrocarbons, which are to be pyrolytically cracked, are passed into the sand bed from below same by a plurality of nozzles situated equi-distant across the cross section width of the reactor. These baffle structures, which are the essence of the patentees' invention, are existent to insure a pressure drop through the reactor chamber. This is antithetical to applicant's catalytic downflow reactor with an applicable pressure differential means situated at the top thereof so as to insure a near zero pressure drop throughout the downflow cracking reactor.

Another method and apparatus for the conversion of liquid hydrocarbons in the presence of a solid material, which may be a catalyst, is disclosed in U.S. Pat. No. 2,458,162, issued to Hagerbaumer. In FIG. 2, a downflow reactor is exemplified with solid particles derived from a dense phase surmounted bed in contact with a liquid charge entered approximately mid-way in the converter column after a control acts on the amount of catalytic material admitted to the converter unit. The amount of descending catalyst is controlled to provide an adequate level of a relatively dense phase of catalyst in the bottom of the reactor. The spent catalyst is reconverted to fresh catalyst in a catalyst reconditioner and then charged to the dense phase catalyst hopper surmounting the converter via a conveyor. Succinctly, this disclosure lacks appreciation of a downflow reactor as hereinafter described with a near zero pressure drop and a horizontal cyclone separator means used to convey regenerated catalyst to the top of the downflow reactor.

Two U.S. patents issued to Tyson U.S. Pat. Nos. 2,420,632 and 2,411,603 demonstrate the use of a reaction zone having a serpentine flow pattern defined by intermittent baffle sections. All of the above references are indicative of various antiquated reactors very distinct from the riser reactors used in contemporary refining practice. In fact, during the last 25 years the advent of the upflow riser reactor has attained near worldwide acceptance particularly in light of the very rapid deactivation rates of various very active zeolite catalysts. The prior art is replete with various techniques of using an upflow catalytic riser for the cracking of hydrocarbons. For example, see Owen, U.S. Pat. No. 3,849,291. The combination of this type of cracking, in addition to a downflow cracking unit, is exemplified by Payne et al U.S. Pat. No. 3,351,584 wherein cracking can take place in a lift pipe or in a downflow cracking reactor containing a dense bed of catalyst material. This prior art has failed to teach a catalytic cracking apparatus without baffles or stages, in a downflow reactor having a near zero pressure drop as a result of the conjunct interaction of an upflow riser regenerator and a downflow catalytic cracking unit interconnected by a horizontal cyclone separator.

A downflow catalytic cracking reactor in communication with an upflow regenerator is disclosed in Niccum et al U.S. Pat. No. 4,514,285 to reduce gas and coke yields from a hydrocarbonaceous feed material. The reactor will discharge the reactant products and catalysts from the reaction zone axially downward directly into the upper portion of an unobstructed ballistic separation zone having a cross sectional area within the range of 20 to 30 times the cross sectional area of the reaction zone. While there will be less coke formed during this type of downflow reaction wherein the catalyst moves with the aid of gravity, coke will still be formed in relatively large quantities. To permit this type of discharge into an unobstructed zone from the bottom of the downflow reactor invites serious "after cracking" pursuant to the extended contact time of the catalyst with the hydrocarbon material. The instant invention is an improvement over Niccum et al by providing specifically obstructed discharge of the downflow reactor comprising a horizontal cyclone separator to divide the catalyst from the hydrocarbon at a time selective for minimum contact of the two entities.

In Larson, U.S. Pat. No. 3,835,029, a downflow concurrent catalytic cracking operation is disclosed having increased yield by introducing vaporous hydrocarbon feed into downflow contact with a zeolite-type catalyst and steam for a period of time of 0.2 to 5 seconds. A conventional stripper and separator receive the catalyst and hydrocarbon products and require an additional vertical-situated cyclone separator to efficiently segregate the vapors from the solid particles.

OBJECTS AND EMBODIMENTS

It is therefore an object of this invention to provide a novel catalytic cracking flow sequence and apparatus therefor with three basic parts of the apparatus in cooperative interaction.

Another object of this invention is to provide a novel apparatus having three specific elements: an upflow riser regenerator, a downflow catalytic cracking unit and a horizontal cyclone separator, the latter of which interconnects the exit of the downflow riser reactor with the inlet of the upflow riser regenerator.

It is yet another object of this invention to provide an apparatus wherein a horizontal cyclone separator passes regenerated catalyst (from the upflow riser regenerator to the downflow riser reactor) to a specific dense phase bed of regenerated catalyst which acts as a pressure seal to insure a smaller or lower pressure in the downflow reactor vis-a-vis the pressure in the surmounted horizontal separator.

In a specific embodiment of this invention, some regeneration may occur or be affirmatively undertaken in this specific dense bed of regenerated catalyst.

Another object of this invention is to provide an apparatus for the conversion of hydrocarbonaceous materials in a reactor having a substantially zero pressure drop in the presence of a regenerated catalytic composition of matter using a downflow reactor scheme at specific temperatures, pressures and defined specific residence times to insure maximum cracking efficiency.

An embodiment of this invention resides in a process for the continuous cracking of a hydrocarbonaceous feed material to a hydrocarbonaceous product material having smaller molecules in a downflow catalytic reactor which comprises: passing said hydrocarbonaceous feed material into the top portion of an elongated downflow reactor in the presence of a catalytic cracking composition of matter at a temperature of from about 500° to 1500° F., a pressure of from about 1 atmosphere to about 50 atmospheres and a pressure drop of near zero to crack the molecules of said hyrocarbonaceous feed material to smaller molecules during a residence time of from about 0.2 sec to about 5 sec. while said hydrocarbonaceous feed material flows in a downward direction towards the outlet of said reactor; withdrawing a hydrocarbonaceous product material and spent catalyst having coke deposited thereon from said outlet of said reactor after said residence time; separating said hydrocarbonaceous product material from said spent catalyst and withdrawing said hydrocarbonaceous product material from the process as product material; passing said spent catalyst with coke deposited thereon to a riser upflow regenerator in addition to added regeneration gas comprising an oxygen-containing gas; raising the temperature in the bottom of said regenerator by a temperature elevation means to arrive at the carbon burning rate and maintaining a relatively dense fast fluidizing bed of regenerating catalyst over nearly the entire length of the upflow riser regenerator having a temperature of from 1100° to 1800° F. and a pressure of from 1 atmosphere to 50 atmospheres wherein said catalyst resides in said upflow regenerator for a residence time of from about 30 sec to about 300 sec; passing said regenerated catalyst and a vapor phase formed from the oxidation of said coke in the presence of said oxygen-containing gas to a cyclone separator situated in a horizontal position; separating said regenerated catalyst from said vapor phase in said horizontal cyclone separator and withdrawing said vapor phase from said process; passing said separated regenerated catalyst from said horizontal cyclone separator to a dense bed of catalyst maintained at a temperature of from about 1000° to 1800° F., and a pressure of from about 1 atmosphere to about 50 atmospheres wherein said catalyst resides in said dense bed for a residence time of from about 1 sec to about 600 secs; and passing regenerated catalyst from said dense bed to the top portion of said downflow reactor for contact with said hydrocarbonaceous feed material entering said top portion of said downflow reactor, wherein the pressure in said dense bed of catalyst is more than 0.5 psi greater than the pressure in said downflow reactor.

Yet another embodiment of this invention resides in an apparatus for the continuous conversion of hydrocarbon feed material to hydrocarbon product material having smaller molecules which comprises: an upflow riser regenerator having a top and a bottom communicating with a spent catalyst and regeneration gas inlet for entry of spent catalyst having coke deposited thereon and an oxygen-containing regeneration gas, wherein said upflow riser regenerator has a relatively dense fast fluidizing bed of catalyst which has been elevated in temperature to a point commensurate with the carbon burning rate; an elongated catalytic hydrocarbon downflow reactor having a top, a bottom and a length of not more than the height of said upflow riser regenerator for converting sid hydrocarbons therein to hydrocarbons of smaller molecules; a cyclone stripping zone connecting said bottom of said upflow riser regenerator and the bottom of said downflow hydrocarbon catalytic reactor equipped with a stripping fluid entry means for entry of a stripping fluid to said cyclone stripping zone; a first horizontal cyclone separation zone for separation of spent catalyst and reaction products intermediate said bottom of said hydrocarbon catalytic downflow reactor and said stripping zone, a second horizontal cyclone separation zone for separation of regenerated catalyst from the coke combustion products situated intermediate and connecting with said top of said riser regenerator and said top of said downflow reactor through a dense phase seal of catalyst situated beneath said second horizontal cyclone separator and a pressure differential means having two sides, one comprising the side juxtaposed to said second dense bed of catalyst and one comprising the side juxtaposed to the top of said catalytic downflow reactor and communicating with said second dense bed of catalyst beneath said second horizontal cyclone to insure passage of regenerated catalyst and hydrocarbon feed material from said second dense bed of catalyst to said top of said downflow reactor with the pressure at the second dense bed side of said pressure differential means being higher than the pressure on the hydrocarbon catalytic downflow reactor side of said pressure differential means.

Another embodiment of this invention resides in an integral hydrocarbon catalytic cracking conversion apparatus for the catalytic conversion of a hydrocarbon feed material to a hydrocarbon product material having smaller molecules which comprises: an elongated catalytic downflow reactor having a hydrocarbon feed inlet at a position juxtaposed to the top upper end of said downflow reactor, a regenerated catalyst inlet at a position juxtaposed to said top upper end of said downflow reactor and a product and spent catalyst withdrawal outlet at a position juxtaposed to the lower bottom of said downflow reactor; an elongated upflow catalytic riser regenerator for regeneration of said spent catalyst from said downflow reactor; a horizontal cyclone consisting of an elongated vessel having a body comprising a top, first imperforate sidewall, a bottom and perforate second side wall for penetration of a hydrocarbon product material outlet withdrawal conduit wherein said catalytic downflow reactor product and spent catalyst withdrawal outlet interconnects a portion of said top of said horizontal elongated vessel at a position off center from a center line of said top of said horizontal elongated vessel as defined by a vertical plane through the diameter of said horizontal body, said interconnection for passage of an admixture of said spent catayst and said hydrocarbon product material in a downward direction into said horizontal elongated vessel; a downcomer elongated relatively vertical conduit interconnecting said vessel bottom at the relatively far end of said vessel opposite interconnection of said vessel top with said catalytic downflow reactor for passage downward through said downcomer vertical conduit of a relatively small amount of said spent catalyst; a hydrocarbon product material outlet withdrawal conduit situated in said perforate second side wall of said elongated vessel beneath and to the side of said interconnection of said catalytic downflow reactor with said top of said vessel for the continuous removal of said hydrocarbon product material and centrifugal separation from said spent catalyst; an inclined slot solid dropout means interconnecting said bottom of said elongated horizontal vessel at a position at least 90° separated from said catalytic downflow reactor interconnection with said top of said vessel as measured by the angle around the circumference of said vessel where 360° degrees equals one complete revolution around said circumference, said inclined slot solid dropout means receiving said spent catalyst by primary mass separation of spent catalyst from said hydrocarbon product material by centrifugal acceleration of said spent catalysts about asid angle of at least 90° degrees in said elongated horizontal vessel, wherein said spent catalysts are accelerated against said horizontal circumference to cause primary mass flow separation and to thereby pass the majority of said spent catalyst through said inclined solid dropout means to said downcomer vertical conduit, wherein said withdrawal conduit, horizontal vessel and catalytic downflow reactor are constructed to insure that the diameter of said withdrawal conduit is smaller than the diameter of said horizontal vessel and said off center ingress of said admixture of said spent catalyst and hydrocarbon products develop a swirl ratio of greater than 0.2 defined by the tangential velocity of said hydrocarbon product across the cross section of said tubular reaction divided by the superficial axial velocity of said hydrocarbon product through the cross section of said withdrawal conduit to form a vortex of said hydrocarbon product in a helical path extending from said imperforate wall opposite said hydrocarbon material withdrawal conduit and extending in a helical flow path to exit through said hydrocarbon material withdrawal conduit to cause the secondary centrifugal separation and disengagement of entrained spent catalyst from said helical-moving hydrocarbon product materials and thereby passage of said disengaged spent catalyst to the point of interconnection of said vessel with said downcomer vertical conduit to pass said disengaged and separated spent catalyst through said downcomer conduit inlet means for entry of an oxygen-containing gas at a position juxtaposed to the bottom of said regenerator, a relatively dense bed of catalyst in the bottom of said upflow regenerator, a relatively dilute phase of catalyst in a portion of said riser regenerator above said dense bed of catalyst and a regenerated catalyst and vapor phase outlet at a position juxtaposed to the top of said regenerator to remove regenerated catalyst and vapors resultant from the oxidation of coke present on said spent catalyst with said oxygen-containing regeneration gas; a connection means for connecting said upper portion of said catalytic downflow reactor with said upper portion of said upflow riser regenerator to provide for transmission of regenerated catalyst having deactivating coke removed for passage from said upflow riser regenerator to said downflow reactor top comprising; a cyclone separation means communicating with said top portion of said upflow riser regenerator and said top portion of said catalytic downflow reactor by means of an intermediate horizontal cyclone for separating said regenerated catalyst from said vapors derived from said upflow riser regenerator, said horizontal cyclone means being in communication with said top portion of said upflow riser regenerator and said upper portion of said catalytic downflow reactor by means of a dense phase of regenerated catalyst and comprising a horizontal elongated vessel having a body comprising a top, a first imperforate sidewall, a bottom and a perforate second side wall for penetration of a hydrocarbon product material outlet withdrawal conduit wherein said upflow riser regenerator interconnects a portion of said bottom at a position off center from a center line of said bottom of said elongated vessel as defined by a vertical plane passing through the diameter of said horizontal body, said interconnection for passage of an admixture of said regenerated catalysts and said spent oxidation gas in a upward direction into said horizontal elongated vessel; a downcomer elongated relatively vertical conduit interconnecting said horizontal elongated vessel bottom at the relatively far end of said vessel opposite interconnection of said vessel bottom with said riser regenerator for passage through said downcomer vertical conduit of a relatively small amount of said regenerated catalyst; a spent oxidation gas outlet withdrawal conduit situated in said perforate second side wall of said horizontal elongated vessel beneath and to the side of said interconnection of said riser regenerator with said bottom of said vessel for the continuous removal of said spent oxidation gas after centrifugal separation from said regenerated catalysts; an inclined slot solid dropout means interconnecting said bottom of said horizontal elongated vessel at a position of about 270° separated from said riser regenerator interconnection with said bottom of said vessel as measured by the angle around the circumference of said vessel where 360° degrees equal one complete revolution around said circumference, said inclined slot solid dropout means receiving said regenerated catalysts by primary mass separation of regenerated catalyst from said spent oxidation gas by centrifugal acceleration of said regenerated catalyst about said angle of about 270° in said horizontal elongated vessel wherein said regenerated catalysts are accelerated against said horizontal circumference to cause primary mass flow separation and to thereby pass the majority of said regenerated catalyst through said inclined solid dropout means to said downcomer vertical conduit; and wherein said withdrawal conduit, horizontal vessel and upflow riser regenerator are constructed to insure that the diameter of said withdrawal conduit is smaller than the diameter of said horizontal vessel and said off center ingress of said admixture of said regenerated catalyst and spent oxidation gases develop a swirl ratio of greater than 0.2 defined by the tangential velocity of said spent oxidation gas across the cross section of said riser regenerator divided by the superficial axial velocity of said spent oxidation gas in a helical path extending from said imperforate wall opposite said spent oxidation gas withdrawal conduit to cause the secondary centrifugal separation and disengagement of entrained regenerated catalyst from said helical-moving spent oxidation gas and thereby passage of said disengaged regenerated catalyst to the point of interconnection of said vessel with said downcomer vertical conduit to pass said disengaged and separated regenerated catalyst through said downcomer conduit to said dense phase of said regenerated catalyst having a pressure reduction means to provide passage from said dense phase of said regenerated catalyst to said top portion of said catalytic downflow reactor.

BRIEF DESCRIPTION OF THE INVENTION

This invention concerns an apparatus and process for an integral hydrocarbon catalytic cracking conversion utilizing at least three interrelated vessels inclusive of: (1) an upflow riser regenerator, (2) a downflow hydrocarbon conversion reactor, and (3) a horizontal cyclone separator connecting the bottom (inlet) of the upflow riser regenerator and the bottom (outlet) of the downflow reactor. The interconnection of the top of the regenerator (outlet) and top of the reactor (inlet) is accomplished by means of a pressure leg seal of a bed of freshly regenerated catalyst to insure that the catalytic hydrocarbon conversion occurs in the downflow reactor at a relatively low pressure drop relative to a riser reactor. In order to establish a viable operation of this integral catalytic conversion system, the catalyst is actually "blown down" by the velocity of the vapor in dispersion with the hydrocarbon reactant feed stream and, if desired, diluent steam. One important advantage of this system is a reduction of 5 to 10 times the amount of catalyst inventory necessary for conversion of the same throughput of hydrocarbonaceous feed stock.

DETAILED DESCRIPTION OF THE INVENTION

As shown in FIG. 1, 2 and 3, hereinafter discussed in more detail, a relatively small low-residence time dense bed of catalyst is situated in a position surmounted with respect to the top of the downflow reactor. This small low-residence time dense bed of catalyst acts to provide a viable leg seal to insure that the pressure above the top of the downflow reactor is higher as compared to the pressure in the downflow reactor itself. This orientation of downflow reactor and dense bed leg seal requires the presence of a special pressure differential means to insure proper dispersion of the reactant hydrocarbon feed material with the passage of the catalyst down the reactor. Various vendors and suppliers for valves that can perform this function include, among others, Kubota American Corporation, Chapman Engineers, Inc. or Tapco International, Inc. These pressure differential valves provide and insure presence of a desired amount of catalyst to achieve the desired hydrocarbon conversion in the downflow reactor. Other means such as a flow restriction pipe may also be used to attain the proper pressure differentials.

The leg seal dense bed of catalyst above the pressure differential means situated atop of the downflow reactor can be supplied by a horizontal cyclone separator interconnecting the exit of an upflow riser regenerator and the inlet to the downflow hydrocarbon catalytic reactor. This separatory vessel is similar to the after-described horizontal cyclone separator which interconnects the respective bottoms of the downflow reactor and riser regenerator.

The process parameters existent in the downflow reactor are a very low pressure drop, i.e. of near zero, a pressure of from about 4 to about 5 atmospheres, although 1 to 50 atmospheres is contemplated, a residence time of about 0.2 to about 5 seconds and a temperature of from about 500° to 1200° F. The pressure differential existent in the downflow reactor vis-a-vis the pressure in the dense phase leg seal (surmounting the downflow reactor) is more than 0.5 psi. This will permit and aid in the downflow of all applicable material such as steam, hydrocarbon reactant and catalyst in a well dispersed phase at the near zero pressure drop.

Both the cracking reactor and riser regenerator operate under fast fluidizing conditions which transpire when the entraining velocity of the vapor exceeds the terminal velocity of the mass of the catalyst. The entrainment velocity can be as great as 3–100 times the individual particle terminal velocity because the dense catalyst flows as groups of particles, i.e. streamers. The minimum velocity for fast fluidizing conditions occurs when the entraining velocity of the vapor exceeds the terminal velocity of the mass of catalyst. The minimum velocity for fast fluidization of the catalyst particles is about one meter/sec at typical densities.

The pressure drop through a fast fluidized system increases with the velocity head ($\frac{1}{2}P_S V_S^2$) whereas the pressure drop through a fluidized bed is relatively constant with respect to the velocity head or flow rate.

Small scale mixing in fast fluidized systems is very efficient because of the turbulence of the flow, however large scale backmixing is much less than in a fluidized bed. The riser regenerator can burn to lower carbon on catalyst with less air consumption than a fluidized bed. In fact, fluidized bed reaction rates are only about 10% of the theoretical burning rate whereas risers could achieve nearly 100%. High efficiencies of that type are required in order to succeed in a riser regenerator.

The downflow reactor is also fast-fluidized despite its downward orientation. The vapor velocity (magnitude) exceeds the catalyst terminal velocity. The vapor entrains the solids down the reactor as opposed to having the solids fall freely. The bottom of the downflow reactor must be minimally obstructed to provide rapid separation of reacted vapor and to prevent backup of solids. This is accomplished by discharging directly into the unique horizontal cyclone separator hereinafter described. The catalyst holdup in the downflow reactor is expected to be about half of that of the holdup in a riser reactor with typical vapor velocities. This is largely due to fast fluidized (turbulent entrainment) conditions. The catalyst contact time becomes one third to one half as long; subsequent regeneration is therefore much easier in this system.

The hydrocarbon feed material can be added to the downflow reactor at a point juxtaposed to entry of the regenerated catalysts intermixed with steam through the above discussed pressure differential means. The hydrocarbon feed will usually have a boiling point of between 200° and 800° F. and will be charged as a partial vapor and a partial liquid to the upper part of the downflow reactor or in the dense phase of catalyst surmounted thereto. Applicable hydrocarbonaceous reactants which are modified to hydrocarbonaceous products having smaller molecules are those normally derived from natural crude oils and synthetic crude oils. Specific examples of these hydrocarbonaceous reactants are distillates boiling within the vacuum gas oil range, atmospheric distillation underflow distillate, kerosene boiling hydrocarbonaceous material or naphtha. It is also contemplated that asphaltene materials could be utilized as the hydrocarbon reactant although not necessarily with equivalent cracking results in light of the low quantity of hydrogen present therein.

In light of the very rapid deactivation observed in the preferred catalyst of this invention (hereinafter discussed), short contact time between the catalyst particles and the hydrocarbonaceous reactant are actually desired. For this reason, multiple reactant feed entry points may be employed along the downflow reactor to maximize or minimize the amount of time the active catalyst actually contacts the hydrocarbonaceous reactants. Once the catalyst becomes deactivated, which can happen relatively fast, contact of the catalyst with the hydrocarbonaceous reactant is simply non-productive. The hydrocarbonaceous products, having smaller molecules than the hydrocarbonaceous feed stream reactants, are preferably gasoline used for internal combustion engines or other fuels such as jet fuel, diesel fuel and heating oils.

The downflow reactor interconnects with an upflow riser regenerator; bottom to bottom, top to top. This interconnection is accomplished by a quick separation means, especially in the bottom to bottom interconnection. It is contemplated that this quick separation means in the top to top connection may comprise a horizontal cyclone separator, a vertical cyclone separator, a reverse flow separator, or an elbow separator having a inlet dimension equal to less than four times the diameter or sixteen times the cross section of the reaction zone. The spent catalyst separation time downstream of the downflow reactor bottom, with this unique horizontal cyclone, will be from 0.2 to 2.0 seconds in contrast to the unobstructed separation time of U.S. Pat. No. 4,514,285 of between 8 seconds and 1 minute. It is therefore necessary for the quick separation means in the bottom to bottom connection to comprise at least one horizontal cyclone separator, preferably commensurate with that described herein.

A preferred horizontal cyclone separator is described in copending Ser. No. 874,966 filed on the same day as this application and entitled "Horizontal Cyclone Separator With Primary Mass Flow and Secondary Centrifugal Separation of Solid and Fluid Phases" and issued as U.S. Pat. No. 4,731,228 on Mar. 15, 1988. All of the intricate teachings of the horizontal cyclone separator of the aforementioned copending application are herein incorporated by reference. The horizontal cyclone separator communicates preferably with the bottommost portion of the downflow reactor (outlet) and the bottommost portion of the upflow riser regenerator (inlet). This horizontal cyclone separator will have an offset inlet in the bottom of the horizontal cyclone separator to charge spent catalyst and hydrocarbon product to the separator at an angular acceleration substantially greater than gravity to force the spent catalyst against the side walls of the horizontal cyclone separator and thereby separate the same by primary mass separation using angular acceleration and centrifugal force.

The horizontal cyclone separator can be equipped with a vortex stabilizer which acts to form a helical flow of vapors from one end of the cyclone separator to the hydrocarbon product outlet end of the same. This vortex acts as a secondary spent catalyst and hydrocarbon product phase separation means to eliminate any entrained spent catalyst from the hydrocarbon product material. The horizontal cyclone separator is equipped with a special solid slot dropout means which interconnects the bottom portion of the horizontal cyclone separator juxtaposed to the inlet of the spent catalyst and hyrocarbon product (gasiform phase) and a downcomer, which itself interconnects the opposite extreme of the horizontal cyclone separator. With this preferred embodiment, spent catalyst is very quickly separated from the hydrocarbonaceous material and thereby aftercracking or excessive coke formation is eliminated or at least mitigated. This horizontal cyclone separator in functional operation with the downflow reactor and the riser regenerator results in a process with more flexibility and better coke formation handling than was previously recognized, especially in the aforementioned U.S. Pat. No. 4,514,285. It is preferred, however, that a stripping zone interconnect the bottom of the horizontal cyclone separator and the bottom of the riser regenerator. In the stripping zone, a stripping medium, most preferably steam or a flue gas, is closely contacted with the catalytic composition of matter having deactivating coke deposited thereon to an extent of from about 0.1% by weight carbon to about 5.0% by weight carbon to remove adsorbed and interstitial hydrocarbonaceous material from the spent catalyst. The stripping vessel may take the form of a conventional vertical stripping vessel having a dense phase of spent catalyst in the bottom thereof, or the stripping vessel may be a horizontal stripping vessel having a dip leg funneling catalyst to a holding chamber composed almost entirely of the dense phase of spent catalysts and unoccupied space. The stripping vessel, regardless of which configuration is used, is normally maintained at about the same temperature as the downflow reactor, usually in a range of from 850° to 1050° F. The preferred stripping gas, usually steam or nitrogen, is introduced at a pressure usually in the range of 10 to 35 psig in sufficient quantities to effect substantially complete removal of volatile components from the spent catalyst. The downflow side of the stripping zone interconnects with a moveable valve means communicating with the upflow riser regenerator system.

The riser regenerator can comprise many configurations to regenerate the spent catalyst to activity levels of nearly fresh catalyst. The principle idea for the riser regenerator is to operate in a dense, fast fluidized mode over the entire length of the regenerator. In order to initiate coke combustion at the bottom of the riser regenerator the temperature must be elevated with respect to the temperature of the stripped spent catalyst charged to the bottom of the riser regenerator. Several means of elevating this temperature involve back mixing actual heat of combustion (i.e., coke to CO oxidation) to the bottom of the riser regenerator. These means include the presence of a dense bed of catalyst, recycle of regenerated catalyst, countercurrent flow of heat transfer agents and an enlarged back mixing section. For example, a dense bed of catalyst may be situated near the bottom of the regenerator but should preferably be minimized to reduce catalyst inventory. Advantages of this invention include a reduction in inventory are capital cost savings, catalyst deactivation mitigation and a reduction in catalyst attrition. Where backmixing of the catalyst occurs the temperature in the bottom of the riser regenerator will increase to a point around the combustion take off temperature, i.e. where the carbon rate is limited by mass transfer and not oxidation kinetics. This raise in temperature may be 100°-300° F. higher than the indigeneous temperature of the incoming stripped spent catalyst. This backmixing section may be referred to as a dense recirculating zone which is necessary for said temperature rise.

In one embodiment of this invention, the upflow riser regenerator comprises a riser regenerator having a dense phase of spent and regenerating catalyst (first dense bed) in the bottom thereof and a dilute phase of catalyst thereabove entering into a second separator, preferably a horizontal cyclone stripper. Spent, but stripped, catalyst from the stripping zone is charged to the bottom of the riser regenerator, which may have present therein a dense bed of catalyst to achieve the temperature of the carbon burning rate. And when such a dense bed of catalyst is used its inventory should be minimized compared to conventional riser regenerators. If desired, a recycle means can be provided, with or without cyclone separators, to recycle regenerated catalyst back to the dense bed of catalyst either internally or externally of the regenerator to attain the carbon burning rate temperature. This quantity of recycled regenerated catalyst can best be regulated by surveying a temperature within the dense phase of the riser regenerator and modifying the quantity of recycle catalyst accordingly. It is also within the scope of this invention that the catalyst recycle itself possess a fluidizing means therein for fluidizing the regenerated recycled catalyst. The extent of fluidization in the recycle conduit can be effected in response to a temperature in the regenerator system to better control the temperature in the dense phase of catalyst in the bottom of the riser regenerator.

The dense phase of catalyst in the regenerator is fluidized via a fluidizing gas useful for oxidizing the coke contained on the spent catalyst to carbon monoxide and then to carbon dioxide, which is eventually removed from the process or utilized to generate power in a power recovery system downstream of the riser regenerator. The most preferred fluidizing gas is air which is preferably present in a slight stoichiometric excess (based on oxygen) necessary to undertake coke oxidation. The excess oxygen may vary from 0.1 to about 25% of that theoretically necessary for the coke oxidation in order to acquire the most active catalyst via regeneration.

Temperature control in an FCC unit is a prime consideration and therefore temperature in the regenerator must be closely monitored. The technical obstacles to an upflow riser regenerator are low inlet temperature and low residence time. In order to mitigate these difficulties a refiner may wish to adopt one of three not mutually exclusive pathways. First, heat transfer pellets may be dropped down through the riser to backmix heat, increase catalyst holdup time, or maximize mass transfer coefficients. Proper pneumatic elevation means can be used to circulate the pellets from the bottom of the riser to the top of the riser if it is desired to recirculate the pellets. Second, regenerated catalyst can be recirculated back to the bottom of the riser to backmix the heat. Third, an expansion section can be installed at the bottom of the riser to backmix heat in the entry zone of the riser regenerator.

The catalyst undergoes regeneration in the riser and can be nearly fully regenerated in the dense phase of catalyst. The reaction conditions established (if necessary by the initial burning of torch oil) and maintained in the riser regenerator is a temperature in the range of from about 1150° to 1400° F. and a pressure in the range of from about 5 to 50 psig. If desired, a secondary oxygen containing gas can be added to the dilute phase at a point downstream of the dense bed of catalyst. It is most preferable to add this secondary source of oxidation gas at a point immediately above the dense phase of catalyst if one exists in the bottom of the generator. It may also be desirable to incorporate a combustion promoter in order to more closely regulate the temperature and reduce the amount of coke on the catalyst. U.S. Pat. Nos. 4,341,623 and 4,341,660 represent a description of contemplated regeneration combustion promoters, all of the teachings of which are herein incorporated by reference.

In the embodiment where the riser regenerator is maintained with a dense bed of catalyst in the bottom, the regenerating catalyst exits the dense phase and is then passed to a dilute phase zone which is maintained at a temperature in the range of from about 1200° to about 1500° F. Again, there must always be struck a relationship of temperature in the regeneration zone necessary to supply hot regenerated catalysts to the reaction zone to minimize heat consumption in the overall process. It is imperative to recognize that the catalyst inventory is going to be greatly reduced vis-a-vis a standard upflow riser reactor and thus a more precise balance of the temperatures in the downflow reactor and upflow regenerator can be struck and maintained. It is also contemplated that the riser regenerator can have a dilute phase of catalyst passed into a disengagement chamber, wherein a second dense bed of catalyst in the regenerator is maintained in the bottom for accumulation and passage through a regenerated catalyst recycle means to the dense phase bed of catalyst in the bottom of the riser regenerator.

It is also contemplated within the scope of this invention that chosen known solid particle heat transfer materials, such as spherical metal balls, phase change materials, heat exchange pellets or other low coke-like solids, be interspersed with the catalyst. In this preferred embodiment, the heat sink particles act to maintain elevated temperatures at the bottom of the regenerator riser and are generically inert to the actual function of the catalyst and desired conversion of the hydrocarbonaceous reactant materials. Notwithstanding the presence of the heat transfer materials, it is preferred that the quantity of carbon on the regenerated catalyst can be held to less than 0.5 wt % and preferably less than 0.02 wt % coke.

The catalyst employed in this invention comprises catalytically active crystalline aluminosilicates having initially high activity relative to conversion of the hydrocarbonaceous material. A preferred catalyst comprises a zeolite dispersed in an alumina matrix. It is also contemplated that a silica-alumina composition of matter be utilized. Other refractory metal oxides such as magnesium or zirconium may also be employed but are usually not as efficient as the silica-alumina catalyst. Suitable molecular sieves may also be employed, with or without incorporation to an alumina matrix, such as faujasite, chabazite, X-type and Y-type aluminosilicate materials, and ultra stable large pore crystalline aluminosilicate materials, such as a ZSM-5 or a ZSM-8 catalyst. The metal ions of these materials should be exchanged for ammonium or hydrogen prior to use. It is preferred that only a very small quantity, if any at all, of the alkali or alkaline earth metals be present.

In an overall view of the instant process, the riser regenerator will be longer than the downflow catalytic reactor. The reason for this size variation in this configuration resides in the rapid loss of catalyst activity in the downflow reactor. It is preferred that the downflow catalytic reactor be not more than one half the length of the riser regenerator.

ILLUSTRATIVE EMBODIMENT

The following description of FIGS. 1 through 3 illustrates an embodiment of this invention which is not to be read as a limitation upon the apparatus and process aspects of this invention and with the understanding that various items such as valves, bleeds, dispersion steam lines, instrumentation and other process equipment have been omitted for the sake of simplicity.

DETAILED DESCRIPTION OF THE INVENTION

Figure 1:
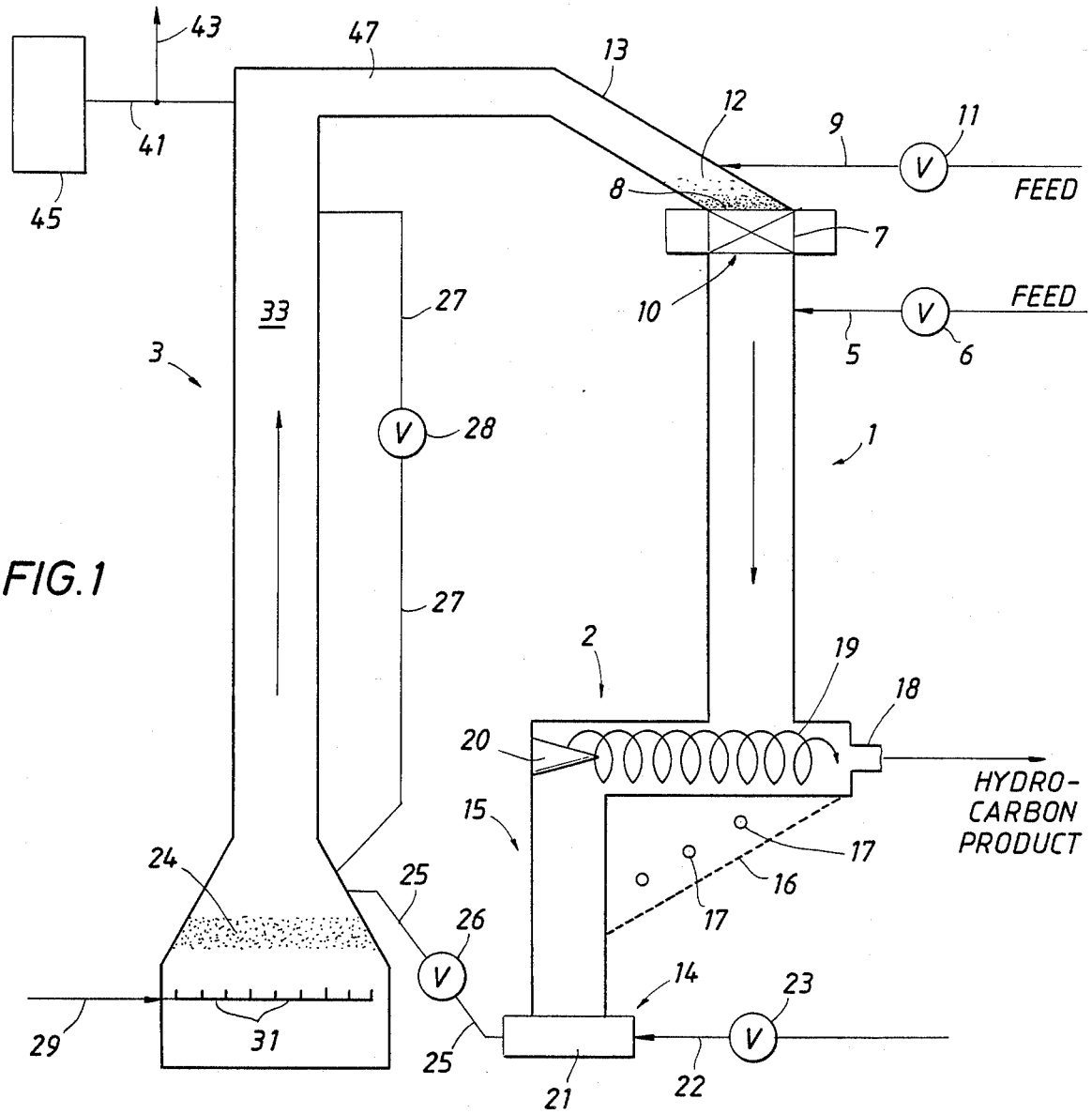
FIG. 1 is an overall view of the instant process inclusive of the horizontal cyclone separator interconnecting the riser regenerator and downflow reactor.

FIG. 1 shows downflow reactor 1 in communication with riser regenerator 3 via horizontal cyclone separator 2. Hydrocarbonaceous feed is added to the flow scheme via conduit 5 and control valve 6 at or near the top of downflow reactor 1. It is preferred that this feed be entered through a manifold system (not shown) to disperse completely the feed throughout the top of the downflow reactor for movement downward in the presence of the regenerated catalyst. The feed addition is most preferably made about 2 meters below the pressure differential means, here shown as a valve, to permit acceleration and dispersion of the catalyst. The regenerated catalyst is added to downflow reactor 1 through pressure differential valve means 7 to insure that the pressure above the top of downflow reactor 1 (denoted as 8) is higher than the pressure in the downflow reactor (denoted as 10). It is most preferred that this pressure differential be greater than 0.5 psig in order to have a viable dispersion of the catalyst throughout the downflow reactor during the relatively short residence time.

The temperature conditions in the downflow reactor will most preferably be 800° to 1500° F. with a pressure of about 4 to 5 atmospheres. The downflow reactor should operate at a temperature hotter than the average riser temperature to reduce the quantity of dispersion steam and to thereby make the catalyst to oil ratio higher. As one salient advantage of this invention, the pressure drop throughout the downflow catalytic reactor will be near zero. If desired, steam can be added at a point juxtaposed to the feed stream or most preferably the steam may be added by means of conduit 9 and valve 11 into second dense phase bed of catalyst 12. This second dense phase bed of catalyst 12 is necessary to insure the proper pressure differential in the downflow reactor. It is preferred that the catalyst reside in this second dense phase bed of catalyst for only as long as it takes to insure a proper leg seal between the above two entities. It is preferred that the residence time in the dip leg be no more than 5 minutes and preferably less than 30 seconds.

Downflow reactor 1 communicates with riser regenerator 3 by means of horizontal cyclone separator 2 and stripping zone 14. Spent catalyst and hydrocarbon product material pass from the bottom of downflow reactor 1 into horizontal cyclone 2 at a spot off-center with respect to the horizontal body of the cyclone. The entry of the different solid and fluid phases undergoes angular forces (usually 270° C.) which separates the phases by primary mass flow separation. The solid particles pass directly to downcomer 15 by means of a solid slot dropout means 16, (not seen from the side view) which can be supported by a fastening and securement means 17. A minor portion of the solid spent catalyst will remain entrained in the hydrocarbonaceous fluid product. The horizontal cyclone 2 is configured such that the tangential velocity of the fluid passing into the vessel (Ui) divided by the axial velocity of fluid fluid passing through product withdrawal conduit 18 (Vi) is greater than 0.2 as defined by:

$$\text{Swirl Ratio} = \frac{Ui}{Vi} = \frac{Re}{Ri} \times \frac{1}{F}$$

wherein

Re=radius of the downflow reactor 1;

Ri=radius of the withdrawal conduit 18; and

F=the cross section area of the tubular reactor divided by the cross sectional area of the fluid withdrawal conduit.

Satisfaction of this relationship develops a helical or swirl flow path of the fluid at 19 in a horizontal axis beginning with an optional vortex stabilizer 20 and continuing through hydrocarbon product outlet 18. This creates disentrainment of the minor portion of the solid spent catalyst which passes to stripper 14 via downcomer 15.

Stripper 14 possesses a third dense bed of catalyst 21 (spent) which is immediately contacted with a stripping agent, preferably air or steam and possibly ammonia, through a stripping gas inlet conduit 22 and control valve 23. After a small residence time in stripper 14 sufficient to excise a portion of the absorbed hydrocarbons from the surface of the catalyst, preferably 10–100 seconds, the spent and stripped catalyst is passed to the first dense phase of catalyst 24 by means of connection conduit 25 and flow control device 26. The third dense phase bed of catalyst 21 will usually have a temperature of about 500° to about 1000° F.

The first dense phase bed of catalyst 24 is maintained on a specially sized grate (not shown) to permit the upflow of vapor through the grate and the downflow of spent catalyst from the dense phase of catalyst. A suitable fluidizing agent is an oxygen-containing gas, which is also used for the oxidation of coke on the catalyst to carbon monoxide and carbon dioxide. The oxygen-containing gas is supplied via conduit 29 and distribution manifold 31. It is within the scope of this invention that the amount of fluidizing gas added to regenerator 3 can be regulated as per the temperature in the combustion zone or the quantity or level of catalyst in first dense bed of catalyst 24. If desired, a regenerated catalyst recycle stream 27 can be provided to recycle regenerated catalyst from the upper portion of the dilute phase of riser regenerator 3 through conduit 27 containing flow control valve 28, which may also be regulated as per the temperature in the dilute phase of the regeneration zone. This catalyst recycle stream, while shown as being external to the riser regenerator may also be placed in an internal position to insure that the catalyst being recycled is not overly cooled in its passage to first dense phase catalyst bed 24. It is also contemplated that conduit 27 can intersect conduit 25 and that a "salt and pepper" mixture of regenerated and spent catalyst be concomitantly added to the first dense phase of catalyst 24 through conduit 25.

Regenerated catalysts and vapor effluent derivative of the oxidation of the coke with oxygen are passed from a dilute phase of catalyst 33 to a separation means, preferably a horizontal cyclone separator but other equivalent separators such as a vertical cyclone separator can also be used. Again, it is contemplated that more than one cyclonic separator be put in service in a series or parallel flow passage scheme. The upflow of regenerated catalysts is removed from the vapors, which contain usually less than 1000 ppm CO through conduit 41 and can be removed from the process in conduit 43 or passed to a power recovery unit 45 or a carbon monoxide boiler unit (not shown). The cyclonic communication conduit 47 acts to excise the catalyst particles from any unwanted vapors and insure passage of regenerated catalyst to the second dense phase of catalyst 12 which provides the leg seal surmounted to the downflow reactor.

Figure 2:
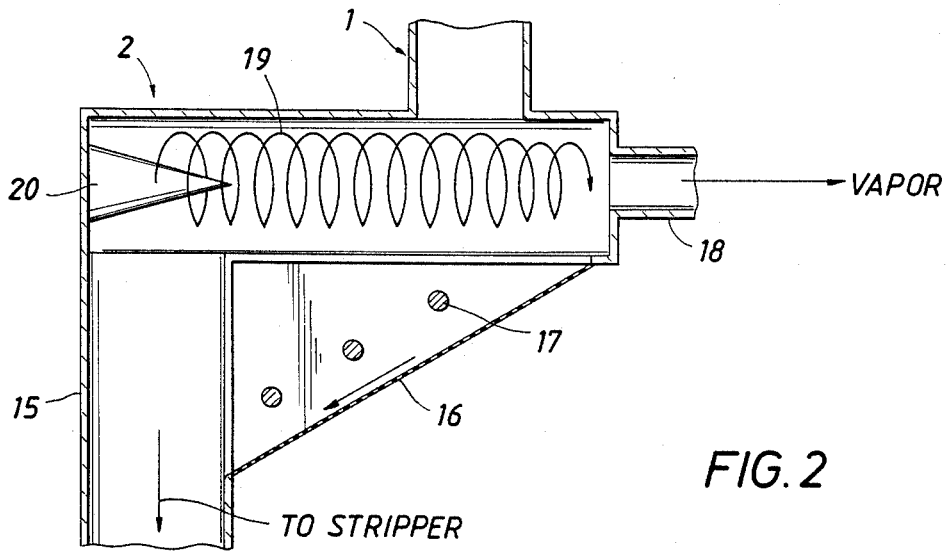
FIG. 2 is an in depth view of the horizontal cyclone separator interconnecting the riser regenerator and downflow reactor.

FIG. 2 shows in more detail the instant horizontal cyclone separator 2 designed for removal of spent catalyst and hydrocarbon product from the downflow reactor to the stripper and ultimately the first dense phase of catalyst in the upflow riser regenerator.

Figure 3:
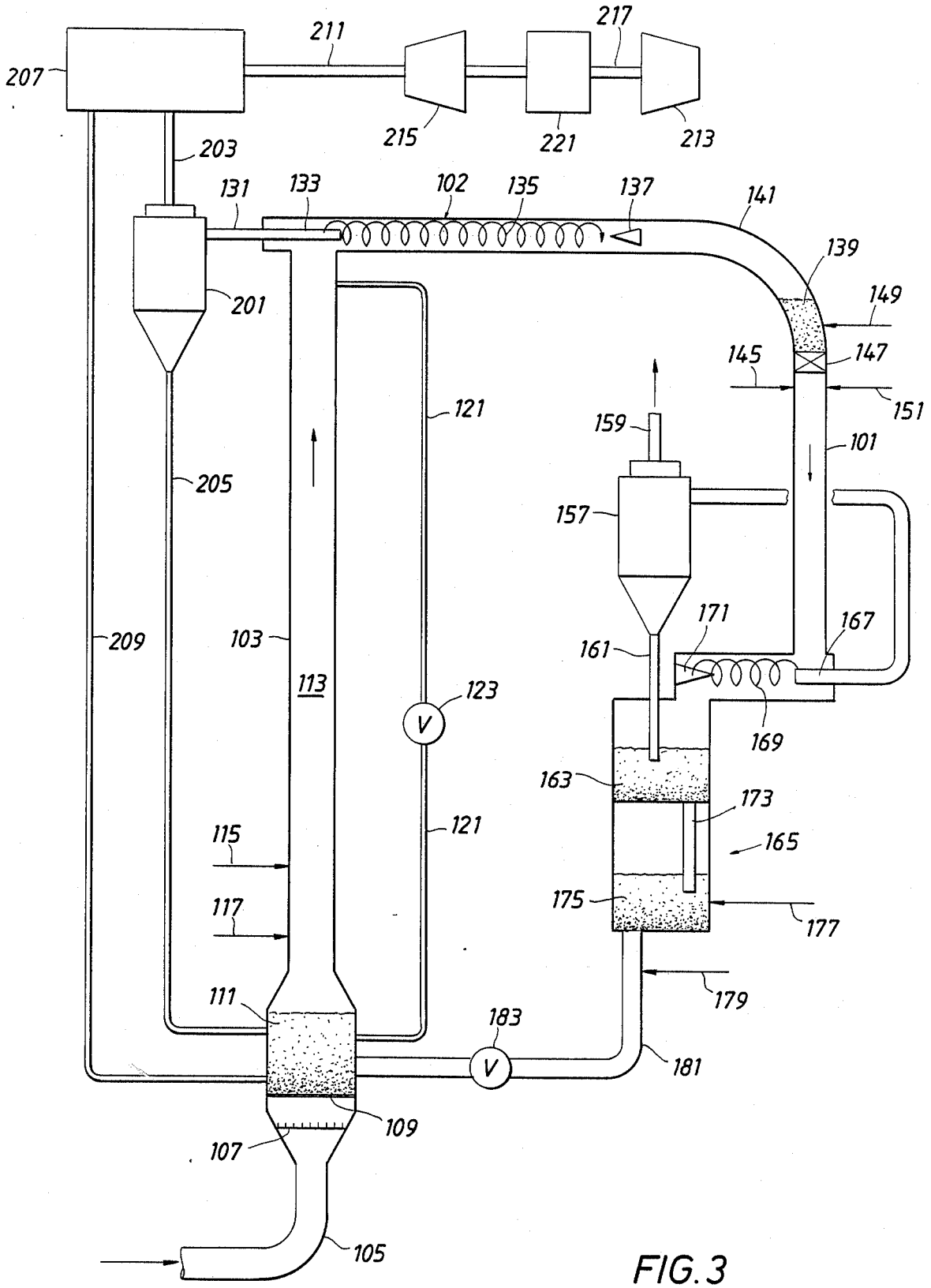
FIG. 3 is a process flow view of the instant process with preferred embodiments contained therein concerning particulate catalyst recovery.

FIG. 3 demonstrates a more sophisticated apparatus and flow scheme of this invention with downflow reactor 101 and riser regenerator 103 interconnected by means of overhead horizontal cyclone separator 102. The lower portion of riser regenerator 103, is supplied with an oxygen-containing gas by means of conduit 105 and manifold 107. A selectively perforated grate 109 is supplied to maintain the bottom of the fluidized bed of catalyst. It is possible that no grate is necessary where the dense phase of catalyst is very small, i.e., 8 ft. in diameter. A dense phase of catalyst 111 is maintained at suitable regeneration-effecting conditions, i.e. a temperature of 1200° to 1500° F., to diminish the coke on the catalyst to 0.05 wt. % coke or less. Catalyst having undergone regeneration in riser regenerator 103 enter dilute phase 113 having in the bottom thereof the ability to add a combustion promoter by means of conduit 115 and/or a secondary air supply means of conduit 117. The amount of air is usually regulated so that the oxygen content is more than stoichiometrically sufficient to burn the nefarious coke to carbon monoxide and then convert some or all of same to carbon dioxide. The regenerated catalyst is entrained upwards through the dilute phase maintained at the conditions hereinbefore depicted and will either enter horizontal cyclone separator 102 or will be recycled to the dense phase of regenerating catalyst 111 by means of recycle conduit 121 and control valve means 123 situated in conduit 121. Again, this recycle stream is shown as being external to the regenerator but could be also internal and contain various process flow control devices such as a level indicator or a temperature sensing and regulating device to regulate temperatures as a function of the conditions existent in dilute phase 113. The combustion products, usually predominantly carbon dioxide, nitrogen, and water exit horizontal cyclone separator 102 through vortex exhaust conduit 131. The vortex exhaust conduit establishes a helical flow of catalyst 135 across the horizontal cyclone separator in a direction substantially perpendicular to riser regenerator 103. This helical flow of catalyst preferably totally surrounds flow deflecting conical device 137 for passage of the particulate catalyst in a downward direction to dense phase leg seal 139. Interconnecting conduit 141 may be a further extension of the horizontal cyclone separator or it can simply be a catalyst transfer conduit from the horizontal cyclone separator. Feed is added by conduit 145 downstream of pressure reduction valve 147. Steam, if desired, may also be added by means of conduit 149 or 151 or both. Pressure differential valve 147 is existent to insure that no hydrocarbons flow upward through the seal leg of catalyst. In this manner solids, such as the catalyst particles, are blown down by the velocity of the descending vapors, which provide good dispersion of catalyst-hydrocarbon reactant-steam. All three of these entities pass downward in reactor 101 to form the sought after hydrocarbon products. In this embodiment, a second horizontal cyclone separator is provided at the bottom of downflow reactor 101. Vapors can exit on either side of the downcomer although in this embodiment vapors exit through vortex exhaust conduit 167 connected to conventional vertical cyclone separator 157. In the latter vertical cyclone separator, gases are withdrawn from the process in conduit 159 while solid catalyst extracted from the vapors are passed by means of dip leg 161 to another dense phase of catalyst 163 existent in steam stripping zone 165. The vortex exhaust conduit 167, also creates a second helical flow path of spent catalyst 169 for passage to stripper dense bed 163 via vortex stabilizer 171. It is contemplated that a dense phase of catalyst 163 may also be provided with a dip leg 173 providing catalysts for yet another dense phase of catalyst 175 existent in the bottom of the stripper column. The latter is provided with two sources of steam in conduits 177 and 179. Stripped, yet spent catalysts, is withdrawn from the bottom of stripper unit 165 via conduit 181 and passed to dense phase bed 111 of riser regenerator 103 via slide control valve 183.

The flow of hot vapors is removed from the horizontal cyclone separator 102 in flow conduit 131. The same is then passed to a conventional vertical catalyst cyclone separator 201 having vapor outlet means 203 and catalyst dip leg 205 for passage of recovered regenerated catalyst back to dense phase 111. The vertical separator 201 passes the off gases to a third horizontal cyclone separator 207 similar in configuration to horizontal cyclone separator 102. Again regenerated catalyst is recovered from hot vapors and recycled in recycle conduit 209 to dense phase catalyst bed 111. The off-gases are predominantly free of solid material in conduit 211, are withdrawn from the horizontal cyclone separator 207 and passed to a power recovery means comprising very broadly a turbine 215 to provide the power in electric motor generator 221 to run other parts of the process for other parts of the refinery or to sell to the public in a power cogeneration scheme and is then passed to compressor 213.

What I claim as my invention is:

1. An integral hydrocarbon catalytic cracking conversion apparatus for the catalytic conversion of a hydrocarbon feed material to a hydrocarbon product material having smaller molecules which comprises:

(a) an elongated catalytic downflow reactor having a top and bottom portion comprising a hydrocarbon feed inlet at a position juxtaposed to said top portion of said downflow reactor, a regenerated catalyst inlet at a position juxtaposed to said top portion of said downflow reactor and a product and spent catalyst withdrawal outlet at a position juxtaposed to said bottom portion of said downflow reactor;

(b) an elongated upflow catalytic riser regenerator having a top and bottom portion for regeneration of spent catalyst passed from said catalytic downflow reactor having a spent catalyst inlet at a position juxtaposed to said bottom portion of said regenerator, a regeneration gas inlet means for entry of an oxygen-containing gas at a position juxtaposed to said bottom portion of said regenerator, a uniform fast fluidized or entrained bed of regenerating catalyst situated from near said bottom to near said top of said riser regenerator and a regenerated catalyst and vapor phase outlet at a position juxtaposed to said top portion said regenerator, said outlet having a means to remove regenerated catalyst and vapors resultant from the oxidation of coke, present on said spent catalyst, with said oxygencontaining regeneration gas;

(c) a horizontal cyclonic separator for separating spent catalyst from hydrocarbon product material, said horizontal cyclone separator being in communication with said bottom portion of said catalytic downflow reactor and said bottom portion of said upflow riser regenerator and comprising:

(i) a horizontal elongated vessel having a body comprising a top having a center line, a first imperforate sidewall, a bottom and a perforate second side wall for penetration of a hydrocarbon product outlet withdrawal conduit, said top of said vessel body communicating with said catalytic downflow reactor to form a point of communication at a location off center from the center line of said top of said vessel as defined by a vertical plane through the diameter of said horizontal body, said point of communication being sufficient to provide passage of an admixture of spent catalyst and hydrocarbon products in a downward direction into said elongated vessel;

(ii) a downcomer elongated relatively vertical conduit interconnecting said vessel bottom at the relatively opposite extreme end of said vessel from said communication of said vessel with said catalytic downflow reactor for passage downward through said downcomer vertical conduit of a relatively minor amount of spent catalyst;

(iii) a hydrocarbon product withdrawal conduit situated in said second side wall of said vessel beneath and to the side of said point of communication of said catalytic downflow reactor with said top of said vessel for the continuous removal of said hydrocarbon product after a secondary centrifugal separation from spent catalyst;

(iv) an inclined slot solid dropout means interconnecting said bottom of said vessel at a position at least 90° separated from said catalytic downflow reactor point of communication with said top of said vessel as measured by an angle around the horizontal circumference of said vessel where 360° degrees equal one complete revolution around said circumference, said dropout means receiving spent catalyst by primary mass separation of spent catalysts from said hydrocarbon product by centrifugal acceleration of spent catalyst about said angle of at least 90° degrees in said horizontal vessel, wherein spent catalyst is accelerated against said horizontal circumference to cause primary mass flow separation and to thereby pass the majority of spent catalyst through said inclined solid dropout means to said downcomer vertical conduit;

(v) wherein said horizontal cyclonic separator and said catalytic downflow reactor are constructed to insure that the diameter of said hydrocarbon product withdrawal conduit is smaller than the diameter of said horizontal vessel and said off center ingress of said admixture of said hydrocarbon product and spent catalyst are constructed to develop a swirl ratio of greater than 0.2 defined by the tangential velocity of said hydrocarbon product across the cross section of said catalytic downflow reactor divided by the superficial axial velocity of fluid through the cross section of said hydrocarbon product withdrawal conduit to produce a vortex of hydrocarbon product with entrained minor quantities of spent catalyst in a helical path extending from said imperforate wall opposite said hydrocarbon product withdrawal conduit to cause said secondary centrifugal separation and disengagement of a minor amount of entrained spent catalyst from said helical hydrocarbon product and thereby passage of a disengaged minor amount of disentrained spent catalyst to the point of interconnection of said vessel with said downcomer vertical conduit to pass disengaged and separated spent catalyst through said downcomer conduit to a stripping zone; and (vi) a stripping zone communicating with said downcomer vertical conduit and said bottom portion of said upflow riser regenerator, said stripping zone comprising a dense bed of spent catalyst received from both 1) said primary mass flow separation via said inclined slot solid dropout means and 2) said secondary centrifugal separation via said downcomer vertical conduit, wherein stripping gas is passed to said stripping zone by means of a stripping gas inlet means and wherein said helical flow path of said hydrocarbon product material extending from said second side wall to said hydrocarbon product material withdrawal outlet prohibits at least a portion of stripping gas from passing upward through said downcomer vertical conduit and into said horizontal vessel;

(d) a connection separation means communicating with said top of said upflow riser regenerator and said top of said catalytic downflow reactor to separate regenerated catalyst, derived from said upflow riser regenerator, from spent oxidation gases, said connection separation means providing a relatively dense phase of catalyst intermediate said top of said catalytic downflow reactor and said top of said upflow regenerator; and (e) a pressure reduction means to attain a higher pressure in said relatively dense phase in said connection separation means immediately upstream of said catalytic downflow reactor compared with the pressure in said top portion of said catalytic downflow reactor.

2. The apparatus of claim 1 wherein said uniform bed of regenerating catalyst comprises a first relatively dense bed of catalyst in said bottom portion of said regenerator and a relatively dilute phase of catalyst in said top portion of said regenerator.

3. The apparatus of claim 1 wherein said uniform bed of regenerating catalyst includes a portion of regenerated catalyst recycled to said bottom of said riser regenerator through a regenerated catalyst recycle means.

4. The apparatus of claim 1 wherein said uniform bed of regenerating catalyst comprises an additive heat exchange means situated in a flow pattern concurrent to the flow pattern of said ascending regenerating catalyst.

5. The apparatus of claim 4 wherein said heat exchange means comprises heat absorbing balls or pellets.

6. The apparatus of claim 1 wherein said uniform bed of regenerating catalyst comprises a first relatively dense bed of catalyst in said bottom portion of said regenerator, a relatively dilute phase of catalyst in said top portion of said regenerator, a portion of regenerated catalyst recycled to said bottom of said riser regenerator through a regenerated catalyst recycle means and additive heat exchange means situated in a flow pattern countercurrent to the flow pattern of said ascending regenerating catalyst.

7. The apparatus of claim 1 wherein said elongated catalytic downflow reactor has a height equal to not more than the height of said elongated upflow catalytic riser regenerator.

8. The apparatus of claim 1 wherein said hydrocarbon feed inlet is positioned at a point directly below said pressure reduction means.

9. The apparatus of claim 1 wherein said connection separation means communicating with said top of said upflow riser regenerator and said top of catalytic downflow reactor comprises:

(i) an inlet means communicating with said top of said upflow riser regenerator;

(ii) a vortex exhaust tube for separating regenerated catalyst from said spent oxidation gas, wherein said regenerated catalyst is accelerated in a substantially horizontal direction in a helical flow path;

(iii) a spent oxidation gas exit means for withdrawal of said spent oxidation gas in said vortex exhaust tube;

(iv) a conical flow control means comprising a vortex stabilizer located at a position in said separation means opposite the extreme end of placement of said vortex exhaust tube and so situated to provide said helical flow path of said spent oxidation gas encompasses said conical shape of said conical flow control means; and (v) an outlet means communicating with said second relatively dense phase of regenerated catalyst to pass regenerated catalyst from said connection separation means to said second relatively dense phase of catalyst.

10. The apparatus of claim 1 wherein said relatively dense phase of regenerated catalyst surmounted to said catalytic downflow reactor possesses a steam inlet means, to add steam with said catalyst to said catalytic downflow reactor.

11. The apparatus of claim 1 wherein a flow direction control means is positioned on said imperforate side of said horizontal vessel and comprises an obelisk protrudance to direct the flow of spent catalyst in a downward direction through said inclined slot dropout means to the relatively dense bed of catalyst in said stripping zone.

12. The apparatus of claim 11 wherein said flow direction control means comprises a narrow spiked-shaped obelisk configuration.

13. The apparatus of claim 1 wherein said upflow riser regenerator has an inlet means for adding a combustion promoter situated at a point elevated with respect to said first relatively dense bed of catalyst.

14. The apparatus of claim 1 wherein said pressure reduction means comprises a pneumatic slide control valve to insure that the pressure in said relatively dense bed of catalyst above said downflow reactor remains at a level higher than the pressure existent in the top portion said hydrocarbon catalyst downflow reactor juxtaposed to said pressure reduction mass.

15. An apparatus for the continuous conversion of a hydrocarbon feed material to a hydrocarbon product material having smaller molecules which comprises:

(a) an upflow riser regenerator having a top and bottom portion and a spent catalyst and regeneration gas inlet in said bottom for entry of spent catalyst having deactivating coke deposited thereon and an oxygen-containing regeneration gas, wherein said upflow riser regenerator has a first relatively dense phase of regenerating catalyst in said bottom portion thereof and a relative dilute phase of regenerating catalyst in said top portion thereof;

(b) an elongated catalytic hydrocarbon downflow reactor having a length of not more than the height of said upflow riser regenerator for converting said hydrocarbons therein to said hydrocarbons of smaller molecules and a hydrocarbon feed inlet at an upper extremity of said reactor;

(c) a cyclone stripping zone communicating with said upflow riser regenerator and a second horizontal cyclone separator, possessed with a stripping fluid entry means for entry of a stripping fluid to said cyclone stripping zone;

(d) a first horizontal cyclone separation zone for separation of regenerated catalyst and spent oxidation gas intermediate said top portion of said upflow riser regenerator and said top portion of said hydrocarbon catalytic downflow reactor and having a second relatively dense phase of regenerated catalyst therebeneath;

(e) a second horizontal cyclone separation zone for separation of spent catalyst and hydrocarbon product intermediate said bottom of said downflow reactor and said upflow riser regenerator comprising:

(i) a horizontal elongated vessel having a body comprising a top having a center line, a first imperforate sidewall, a bottom and a perforate second side wall for penetration of a hydrocarbon product outlet withdrawal conduit, said top of said vessel body communicating with said catalytic downflow reactor to form a point of communication at a location off center from the center line of said top of said vessel as defined by a vertical plane through the diameter of said horizontal body, said point of communication being sufficient to provide passage of an admixture of spent catalyst and said hydrocarbon products in a downward direction into said elongated vessel;

(ii) a downcomer elongated relatively vertical conduit interconnecting said vessel bottom at the relatively opposite extreme end of said vessel from said communication of said vessel with said catalytic downflow reactor for passage downward through said downcomer vertical conduit of a relatively minor amount of spent catalyst;

(iii) a hydrocarbon product withdrawal conduit situated in said second side wall of said vessel beneath and to the side of said point of communication of said catalytic downflow reactor with said top of said vessel for the continuous removal of hydrocarbon product after a secondary centrifugal separation from spent catalyst;

(iv) an inclined slot solid dropout means interconnecting said bottom of said vessel at a position at least 90° separated from said catalytic downflow reactor point of communication with said top of said vessel as measured by an angle around the horizontal circumference of said vessel where 360° degrees equal one complete revolution around said circumference, said dropout means receiving spent catalyst by primary mass separation of spent catalysts from said hydrocarbon product by centrifugal acceleration of said spent catalyst about said angle of at least 90° degrees in said horizontal vessel, wherein spent catalyst is accelerated against said horizontal circumference to cause primary mass flow separation and to thereby pass the majority of spent catalyst through said inclined solid dropout means to said downcomer vertical conduit;

(v) wherein said horizontal vessel and said catalytic downflow reactor are constructed to insure that the diameter of said hydrocarbon product withdrawal conduit is smaller than the diameter of said horizontal vessel and said off center ingress of said admixture of said hydrocarbon product and spent catalyst are constructed to develop a swirl ratio of greater than 0.2 defined by the tangential velocity of hydrocarbon product across the cross section of said catalytic downflow reactor divided by the superficial axial velocity of fluid through the cross section of said hydrocarbon product withdrawal conduit to produce a vortex of hydrocarbon product with entrained minor quantities of spent catalyst in a helical path extending from said imperforate wall opposite said hydrocarbon product withdrawal conduit to cause said secondary centrifugal separation and disengagement of said minor amount of entrained spent catalyst from the helical hydrocarbon product and thereby passage of the disengaged minor amount of disentrained spent catalyst to the point of interconnection of said vessel with said downcomer vertical conduit to pass disengaged and separated spent catalyst through said downcomer conduit to a stripping zone; and (vi) a stripping zone communicating with said downcomer vertical conduit and said bottom portion of said upflow riser regenerator, said stripping zone comprising a dense bed of spent catalyst received from both (1) said primary mass flow separation via said inclined slot solid dropout means and (2) said secondary centrifugal separation via said downcomer vertical conduit, wherein stripping gas is passed to said stripping zone by means of a stripping gas inlet means and wherein said helical flow path of hydrocarbon product material extending from said second side wall to said hydrocarbon product material withdrawal outlet prohibits at least a portion of stripping gas from passing upward through said downcomer vertical conduit and into said horizontal vessel; and (f) a pressure differential means communicating with said second relatively dense bed of regenerated catalyst in said first horizontal cyclone to insure passage of regenerated catalyst from said second relatively dense bed of regenerated catalyst to said downflow reactor, wherein the pressure at the dense bed side of said pressure differential means being higher than the pressure on the hydrocarbon catalytic downflow reactor side of said pressure differential valve means.

16. The apparatus of claim 15 wherein said upflow riser regenerator has a combustion promoter inlet situated at a position in the lower portion of said dilute phase of catalyst above said first dense phase bed of catalyst.

17. The apparatus of claim 15 wherein said stripping fluid entry means comprises a conduit for entry of steam to said cyclone stripping zone of element (c).

18. The apparatus of claim 15 wherein said first horizontal cyclone zone comprises a vortex tube centrifugal separator.

19. The apparatus of claim 15 wherein a flow direction means comprises an obelisk-shaped spike is positioned in a plane substantially perpendicular with respect to the axial planes of said upflow riser regenerator and said downflow catalytic reactor.

* * * * *